US011002450B2

(12) United States Patent
Suel, II

(10) Patent No.: US 11,002,450 B2
(45) Date of Patent: May 11, 2021

(54) COOKTOP APPLIANCE AND ENGAGEMENT SYSTEM

(71) Applicant: Haier US Appliance Solutions, Inc., Wilmington, DE (US)

(72) Inventor: Richard Dean Suel, II, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 292 days.

(21) Appl. No.: 16/040,858

(22) Filed: Jul. 20, 2018

(65) Prior Publication Data

US 2020/0025387 A1 Jan. 23, 2020

(51) Int. Cl.
*F24C 7/08* (2006.01)

(52) U.S. Cl.
CPC ..... *F24C 7/083* (2013.01)

(58) Field of Classification Search
CPC ..... F24C 7/083
USPC ..... 219/448.12; 374/121, 163
See application file for complete search history.

(56) References Cited

U.S. PATENT DOCUMENTS 8,398,303 B2 * 3/2013 Kuhn ..... G01K 1/026 374/163
2008/0229935 A1 * 9/2008 Strutin-Belinoff ..... F24C 7/082 99/339
2011/0148775 A1 * 6/2011 Rudolph ..... H03K 17/96 345/173
2014/0165849 A1 6/2014 Mateos Martin et al.
2015/0117489 A1 * 4/2015 McGurk ..... G01J 5/0809 374/121
2016/0320040 A1 11/2016 Kang et al.
2018/0128493 A1 * 5/2018 Chen ..... H05B 3/746

FOREIGN PATENT DOCUMENTS

CN 106545896 A 3/2017
WO WO2017026960 A1 2/2017

OTHER PUBLICATIONS

RH Peterson Co, Premium Outdoor Grills, Fire Magic, California, 1-28.

* cited by examiner

*Primary Examiner* — Tu B Hoang
*Assistant Examiner* — Thomas J Ward
(74) *Attorney, Agent, or Firm* — Dority & Manning, P.A.

(57) ABSTRACT

A cooktop appliance or engagement system having a multicolor light display is provided herein. The cooktop appliance may include an electric heating element mounted to a housing. A user may be input mounted to the housing at a control panel. The multicolor light display may be positioned about the user input at the control panel. The multicolor display may be configured to selectively emit a plurality of illumination colors. A controller may be operably coupled to the multicolor light display and configured to initiate a color-variable cooking operation.

14 Claims, 7 Drawing Sheets

COOKTOP APPLIANCE AND ENGAGEMENT SYSTEM

FIELD OF THE INVENTION

The present subject matter relates generally to systems for aiding cooking operations, and more particularly to systems for enhancing cooking engagement and convenience with a cooktop appliance.

BACKGROUND OF THE INVENTION

Cooktop or range appliances generally include heating elements for heating cooking utensils, such as pots, pans, and griddles. A variety of configurations can be used for the heating elements located on the cooking surface of the cooktop. The number of heating elements or positions available for heating on the range appliance can include, for example, four, six, or more depending upon the intended application and preferences of the buyer. These heating elements can vary in size, location, and capability across the appliance.

Common cooktop appliances include a separate user input or knob for each heating element. In some instances, a single light is positioned adjacent to each user input. Each light may be configured to emit a single color, for example, when the adjacent user input is set in an active position (i.e., a position that directs heating or activation of the corresponding heat element). Further information may be provided or displayed at, for example, a single color or monochrome digital display.

Although such systems may be useful for indicating or conveying a single piece of information, such systems present several challenges and shortcomings. In particular, the single light may be difficult to see. Even if the light is visible, a user may have difficulty in readily identifying the corresponding user input or heating element. Moreover, if multiple user inputs and lights are provided, it may be difficult to quickly distinguish one from the other. Reading or consulting a monochrome digital display may be useful for viewing detailed information, but it may also be cumbersome and time-consuming. It may be difficult for a user to easily and quickly ascertain important information regarding the cooking appliance or cooking operation. Furthermore, many systems are entirely passive (e.g., such that an action by the system is only taken in direct response to a specific user instruction). Operations, such as following a cooking recipe, may be entirely dependent on user's own knowledge and reading comprehension.

As a result, it would be useful to provide a cooking appliance or system addressing one or more of the above identified issues. In particular, it would be advantageous to provide a cooking appliance capable of quickly and clearly communicating feedback and instructions for the cooking appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooktop appliance is provided. The cooktop appliance may include a housing, an electric heating element, a user input, a multicolor light display, and a controller. The housing may define a top surface and a control panel. The electric heating element may be mounted to the housing at the top surface. The user may be input mounted to the housing at the control panel. The multicolor light display may be positioned about the user input at the control panel. The multicolor display may be configured to selectively emit a plurality of illumination colors. The controller may be operably coupled to the multicolor light display. The controller may be configured to initiate a color-variable cooking operation. The color-variable cooking operation may include activating the electric heating element, receiving a temperature signal subsequent to activating the electric heating element, and projecting one illumination color of the plurality of illumination colors from the multicolor light display based on the received temperature signal.

In another exemplary aspect of the present disclosure, a cooktop appliance is provided. The cooktop appliance may include a housing, a heating element, a user input, a multicolor light display, an external temperature probe, and a controller. The housing may define a top surface and a control panel. The electric heating element may be mounted to the housing at the top surface. The user may be input mounted to the housing at the control panel. The multicolor light display may be positioned about the user input at the control panel. The multicolor display may be configured to selectively emit a plurality of illumination colors. The external temperature probe may be independently movable relative to the housing. The controller may be operably coupled to the multicolor light display. The controller may be configured to initiate a color-variable cooking operation. The color-variable cooking operation may include activating the heating element, receiving a communications signal from the external temperature probe, and projecting one illumination color of the plurality of illumination colors from the multicolor light display corresponding to the external temperature probe.

In yet another exemplary aspect of the present disclosure, a cooking engagement system is provided. The cooking engagement system may include a cookpot appliance, an image monitor, and a controller. The cooktop appliance may include a housing, a heating element, a user input, and a multicolor light display. The housing may define a top surface and a control panel. The electric heating element may be mounted to the housing at the top surface. The user may be input mounted to the housing at the control panel. The multicolor light display may be positioned about the user input at the control panel. The multicolor display may be configured to selectively emit a plurality of illumination colors. The image monitor may be spaced apart from the top surface of the cooktop appliance. The controller may be operably coupled to the multicolor light display and the image monitor. The controller may be configured to initiate a color-variable cooking operation. The color-variable cooking operation may include reading a recipe signal, and coordinating activation of the image monitor and the multicolor light display based on a displayed recipe instruction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
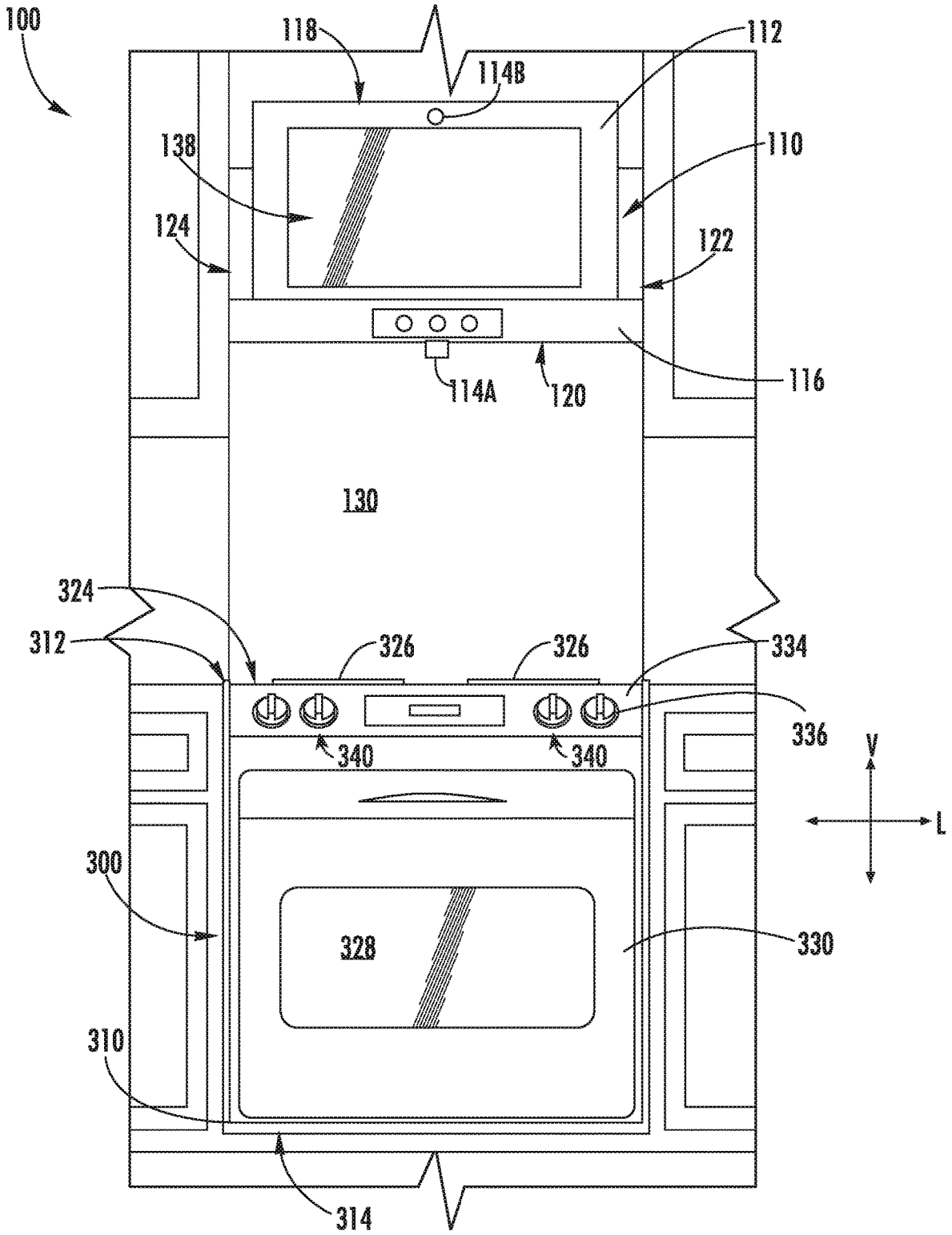
FIG. 1 provides a front perspective view of a system according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present disclosure. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
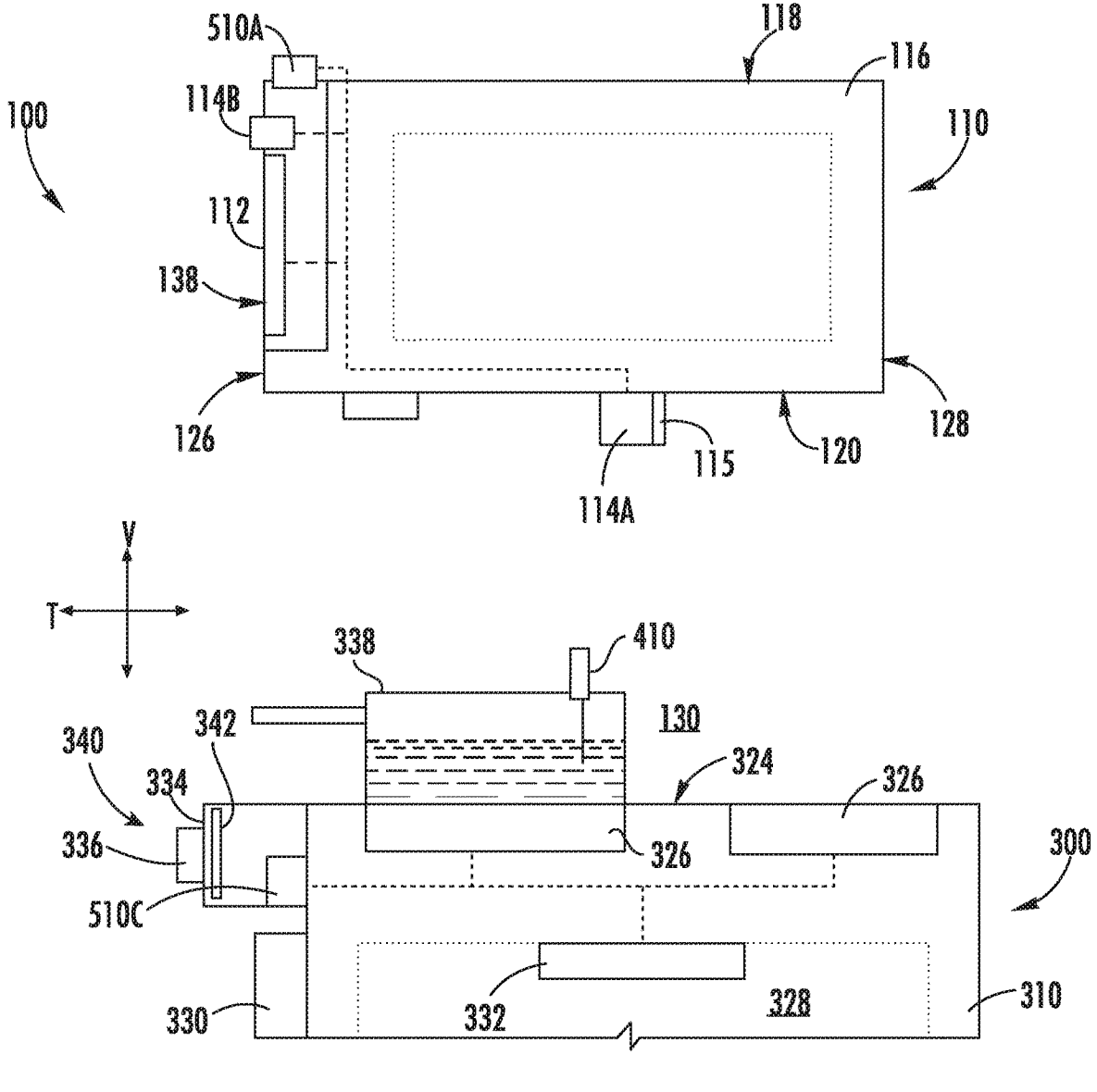
FIG. 2 provides a side schematic view of the exemplary system of FIG. 1.
Figure 3:
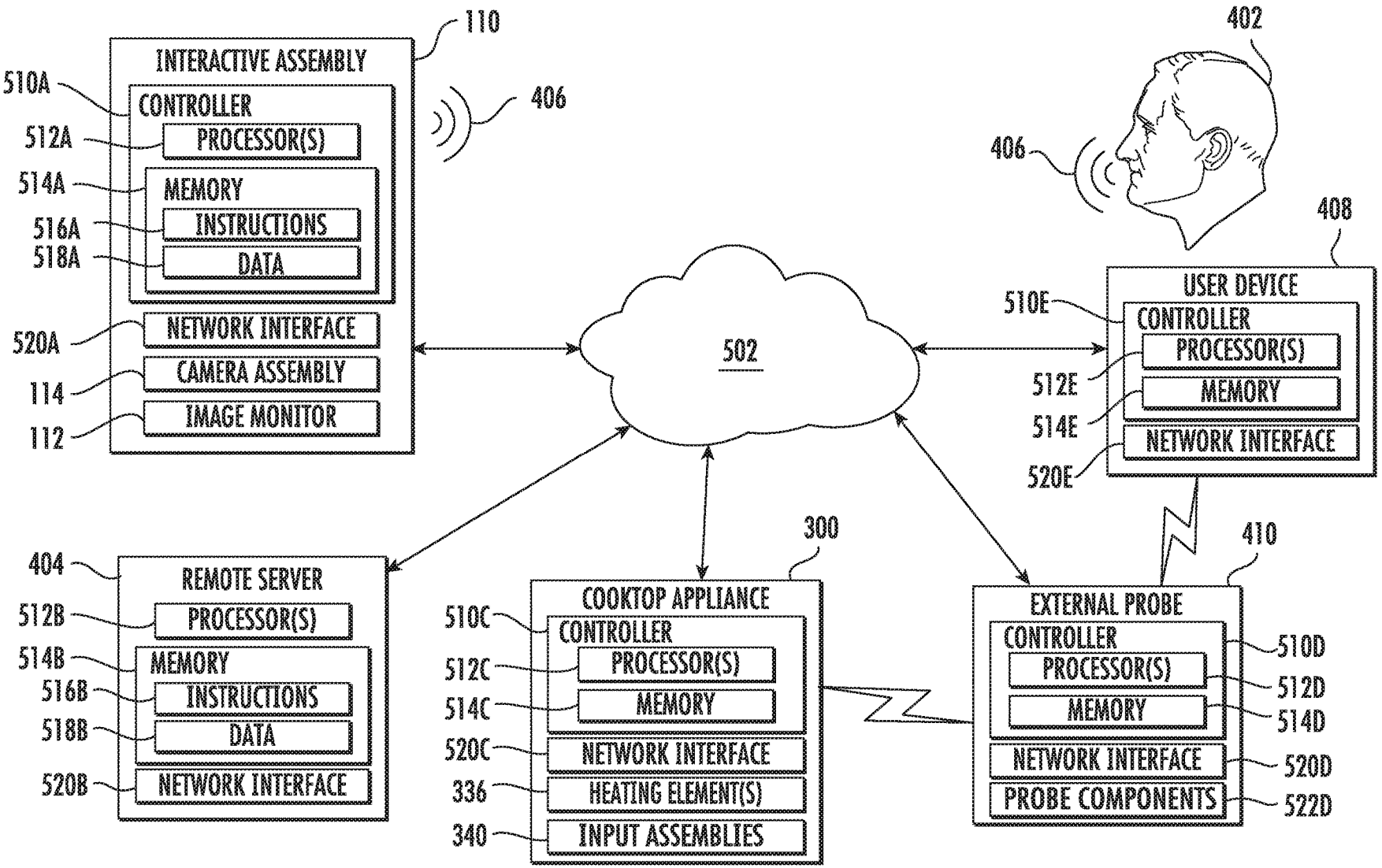
FIG. 3 provides a schematic network view of a system according to exemplary embodiments of the present disclosure.

Turning to the figures, FIGS. 1 through 3 provide various views of a system 100 including a cooktop appliance 300 according to exemplary embodiments of the present disclosure. As shown cooktop appliance 300 generally defines a vertical direction V, a lateral direction L, and a transverse direction T. The vertical, lateral, and transverse directions are mutually perpendicular and form an orthogonal direction system. In some embodiments, cooktop appliance 300 extends along the vertical direction V between a top portion 312 and a bottom portion 314; along the lateral direction L between a left side portion and a right side portion; and along the traverse direction T between a front portion and a rear portion.

Cooktop appliance 300 can include a housing or cabinet 310 that defines a top surface 324 and control panel 334. As shown, one or more heating elements 326 are mounted to cabinet 310 at top surface 324 for use in, for example, heating or cooking operations. In one example embodiment, top surface 324 is constructed with ceramic glass. In other embodiments, however, top surface 324 may include another suitable material, such as a metallic material (e.g., steel) or another suitable non-metallic material. Heating elements 326 may be various sizes and may employ any suitable method for heating or cooking an object, such as a cooking utensil 338, and its contents. In certain embodiments, one or more of the heating elements 326 provided as electric heating elements (e.g., resistive heating element, radiant heating element, induction heating element, etc.). In some embodiments, heating element 326 uses a heat transfer method, such as electric coils or gas burners, to heat the cooking utensil. In other embodiments, however, heating element 326 uses an induction heating method to heat the cooking utensil directly.

In optional embodiments, cooktop appliance 300 includes an insulated cabinet 310 that defines a cooking chamber 328 selectively covered by a door 330. One or more heating elements 332 (e.g., top broiling elements or bottom baking elements) may be enclosed within cabinet 310 to heat cooking chamber 328. Heating elements 332 within cooking chamber 328 may be provided as any suitable element for cooking the contents of cooking chamber 328, such as an electric resistive heating element, a gas burner, microwave element, halogen element, etc. Thus, cooktop appliance 300 may be referred to as an oven range appliance. As will be understood by those skilled in the art, cooktop appliance 300 is provided by way of example only, and the present subject matter may be used in any suitable cooking appliance, such as a double oven range appliance or a standalone cooktop (e.g., fitted integrally with a surface of a kitchen counter). Thus, the example embodiments illustrated in figures are not intended to limit the present subject matter to any particular cooking chamber or heating element configuration, except as otherwise indicated.

As illustrated, control panel 334 may be provided on cooktop appliance 300. Although shown at front portion of cooktop appliance 300, another suitable location or structure (e.g., a backsplash) for supporting control panel 334 may be provided in alternative embodiments. In some embodiments, control panel 334 includes one or more user inputs or controls 336, such as one or more of a variety of electrical, mechanical, or electro-mechanical input devices. In other words, controls 336 may be mounted to cabinet 310 at control panel 334. Controls 336 may include, for example, rotary dials, knobs, push buttons, etc. A controller 510C is operably coupled (e.g., wirelessly coupled or electrically coupled) to and in communication with control panel 334 and controls 336 through which a user may select various operational features and modes and monitor progress of cooktop appliance 300. In certain embodiments, one or more of the controls 336 is included with a multicolor light display 342 as part of an input assembly 340 that is operably coupled to controller 510C. In additional or alternative embodiments, control panel 334 includes a display component, such as a digital appliance screen 346 that is operably coupled to controller 510C and configured to provide operational feedback to a user. In certain embodiments, control panel 334 represents a general purpose I/O ("GPIO") device or functional block.

As shown, controller 510C is operably coupled to control panel 334 and its controls 336. Controller 510C may also be operably coupled to various operational components of cooktop appliance 300 as well, such as heating elements (e.g., 326, 332), sensors, etc. Input/output ("I/O") signals may be routed between controller 510C and the various operational components of cooktop appliance 300. Thus, controller 510C can selectively activate and operate these various components. Various components of cooktop appliance 300 are operably coupled to controller 510C via one or more communication lines such as, for example, conductive signal lines, shared communication busses, or wireless communications bands.

In some embodiments, controller 510C includes one or more memory devices 514C and one or more processors 512C. The processors 512C can be any combination of general or special purpose processors, CPUs, or the like that can execute programming instructions or control code associated with operation of cooktop appliance 300. The memory devices 514C (i.e., memory) may represent random access memory such as DRAM or read only memory such as ROM or FLASH. In one embodiment, the processor 512C executes programming instructions stored in memory 514C. The memory 514C may be a separate component from the processor 512C or may be included onboard within the processor 512C. Alternatively, controller 510C may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 510C includes a network interface 520C such that controller 510C can connect to and communicate over one or more networks (e.g., network 502) with one or more network nodes. Controller 510C can also include one or more transmitting, receiving, or transceiving components for transmitting/receiving communications with other devices communicatively coupled with cooktop appliance 300. Additionally or alternatively, one or more transmitting, receiving, or transceiving components can be located off board controller 510C. Generally, controller 510C can be positioned in any suitable location throughout cooktop appliance 300. For example, controller 510C may be located proximal to or behind control panel 334 toward a front portion of cooktop appliance 300.

In some embodiments, cooktop controller 510C is provided as or as part of controller 510A. In alternative embodiments, cooktop controller 510C is a discrete unit in selective operable communication with a controller 510A and interactive assembly 110, as further described below.

Figure 4:
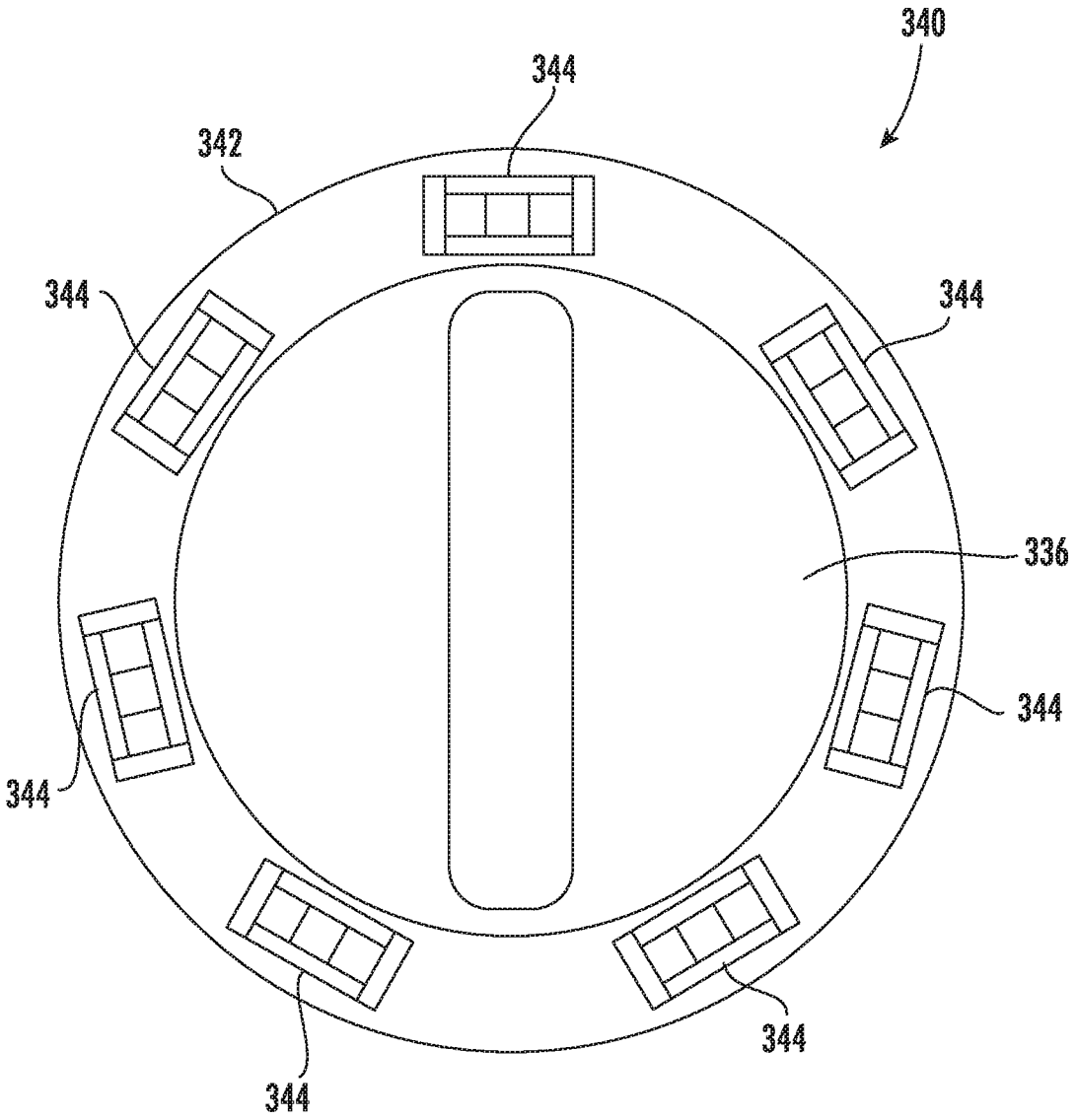
FIG. 4 provides a front plan view of an input assembly according to exemplary embodiments of the present disclosure.
Figure 5:
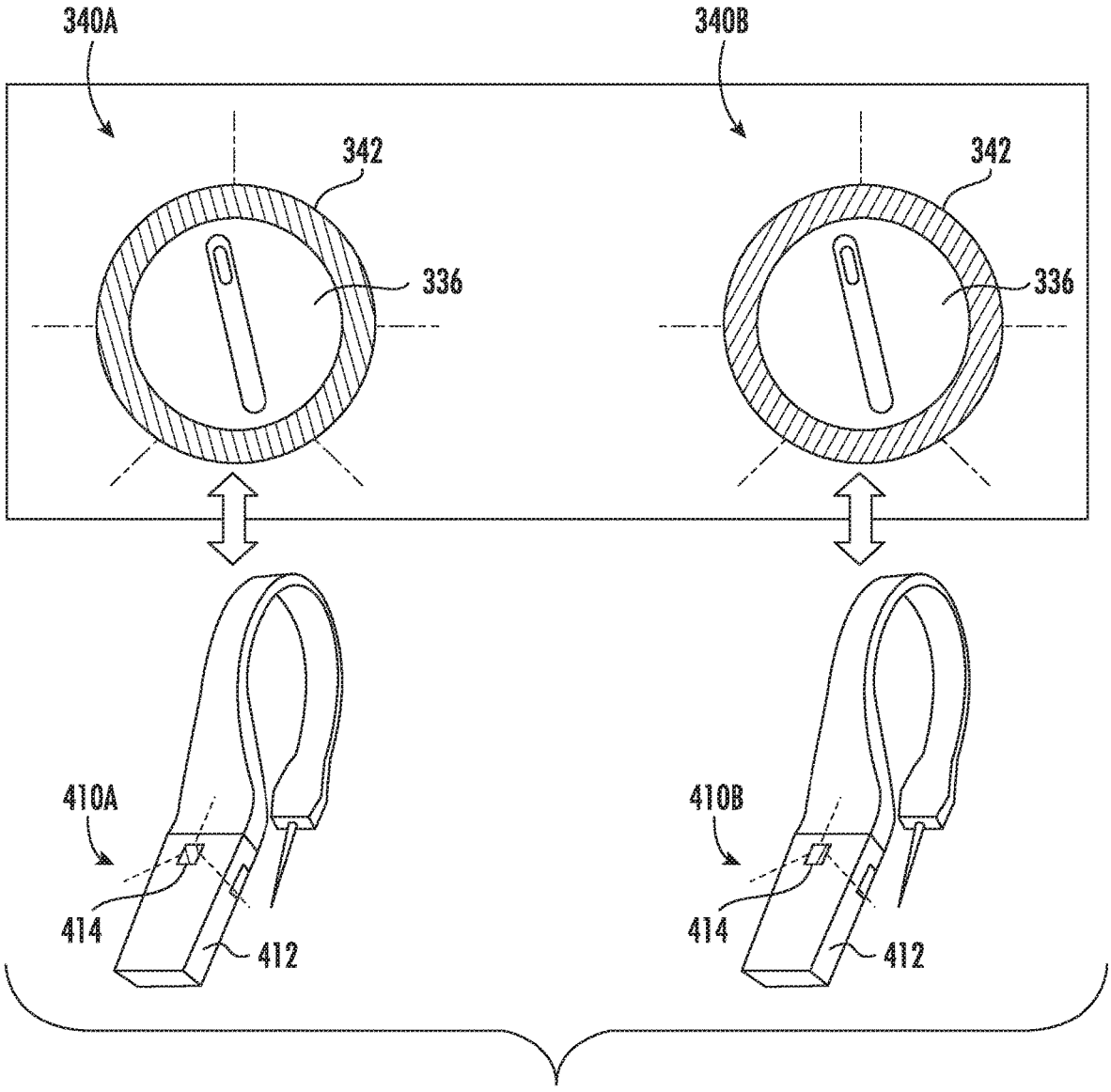
FIG. 5 provides a perspective view of a multiple input assemblies and external temperature probes according to exemplary embodiments of the present disclosure.

Turning briefly to FIGS. 4 and 5, as noted above, one or more input assemblies 340 having a corresponding user inputs 336 (e.g., knob) and multicolor light display 342 may be provided at or on control panel 334. As shown, multicolor light display 342 is positioned about corresponding user inputs 336. A plurality of light sources 344 (e.g., multicolored light emitting diodes—LEDs) are, for example, circumferentially spaced apart from each other. Thus, at least one light source 344 may be located at a discrete position or location relative to another light source 344 surrounding the user inputs 336. In some such embodiments, at least one light source 344 is circumferentially spaced apart from another light source 344 by at least 50°. In additional or alternative embodiments, at least one light source 344 is circumferentially spaced apart from another light source 344 by at least 90°. In yet another additional or alternative embodiments, at least one light source 344 is circumferentially spaced apart from another light source 344 by 180°.

Generally, multicolor light display 342 is configured to selectively emit a plurality of illumination colors. During operations (e.g., cooking operations), multicolor light display 342 may thus be selectively activated to project various colors of light (i.e., light waves along visible color spectrum). In some such embodiments, multicolor light display 342 selectively projects one illumination color of the plurality of illumination colors at a time. The specific illumination color (i.e., one illumination color of the plurality of formation colors) that is projected at a given point in time may relate to one or more specific conditions within the system 100. As an example, a specific color may indicate a specific temperature (e.g., measured temperature or, alternatively, predetermined temperature setting) for the corresponding heating element 326 or user input 336 (FIG. 2). Different colors; such as yellow, orange, and red; may indicate different temperatures or ranges of temperatures. As another example, a specific color may indicate a connection between a corresponding user input 336 or heating element 326 and a separate component (e.g., an external temperature probe 410). Different colors may indicate a connection to a different component. Optionally, the separate component may project an identifying illumination color that matches the specific color of the corresponding multicolor light display 342 (e.g., a blue color may be projected by both a multicolor light display 342 and a corresponding external probe 410). As yet another example, a specific color may indicate a subsequent or completed guided action performed by a user. A multicolor light display 342 may project, for instance, a green light about a corresponding user input 336 that a user should engage or rotate (e.g., as a guided action provided within the context of a specific recipe).

In some embodiments, an external temperature probe 410 is provided, for instance, to detect the temperature of cooking utensil 338 (or food items therein) on top surface 324. As shown, an external temperature probe 410 generally includes a probe body 412 that support various probe components 520D and is independently movable relative to cabinet 310. One or more temperature-detecting circuits or mechanisms (e.g., thermistor, thermocouple, etc.) may be mounted to probe body 412. Within probe body 412, a controller 510D may be provided. In optional embodiments, a separate probe display 414, including one or more light sources (e.g., light emitting diodes—LEDs), may be provided on or within probe body 412 to project one or more visible light emissions (e.g., to a user at cooktop appliance 300). In additional or alternative embodiments, a network interface 520D (e.g., FIG. 3) may be mounted within probe body 412.

As illustrated in FIG. 5, in certain exemplary embodiments wherein multiple discrete input assemblies 340A and 340B are provided, multiple discrete corresponding external temperature probes 410A and 410B may also be provided. In some such embodiments, each corresponding pair (e.g., 340A-410A and 340B-410B) is configured to display a unique matching illumination color. For instance, the matching illumination color projected by one corresponding pair 340A-410A may be blue, while the matching illumination color projected by another corresponding pair 340B-410B may be green.

As illustrated in FIG. 3, controller 510D includes one or more memory devices 514D and one or more processors 512D. The processors 512D can be any combination of general or special purpose processors, CPUs, or the like that can execute programming instructions or control code associated with operation of external temperature probe 410. The memory devices 514D (i.e., memory) may represent random access memory such as DRAM or read only memory such as ROM or FLASH. In one embodiment, the processor 512D executes programming instructions stored in memory 514D. The memory 514D may be a separate component from the processor 512D or may be included onboard within the processor 512D. Alternatively, controller 510D may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 510D includes a network interface 520D such that controller 510D can connect to and communicate over one or more networks (e.g., network 502) with one or more network nodes. Controller 510D can also include one or more transmitting, receiving, or transceiving components for transmitting/receiving communications with other devices operably coupled with external temperature probe 410. Additionally or alternatively, one or more transmitting, receiving, or transceiving components can be located off board controller 510D.

Returning now generally to FIGS. 1 through 3, one or more casings (e.g., hood casing 116) may be provided above cooktop appliance 300 along the vertical direction V. For example, a hood casing 116 may be positioned above cooktop appliance 300. Hood casing 116 includes a plurality of outer walls and generally extends along the vertical direction V between a top end 118 and a bottom end 120; along the lateral direction L between a first side end 122 and a second side end 124; and along the transverse direction T between a front end 126 and a rear end 128. In some embodiments, hood casing 116 is spaced apart from top surface 324 along the vertical direction V. An open region 130 may thus be defined along the vertical direction V between top surface 324 and bottom end 120.

In optional embodiments, hood casing 116 is formed as a range hood. However, a range hood is provided by way of example only. Other configurations may be used within the spirit and scope of the present disclosure. For example, hood casing 116 could be part of a microwave or other appliance designed to be located over top surface 324. Hood casing 116 may also be provided as a dedicated support frame without any other specific function or capability. Moreover, although a generally rectangular shape is illustrated, any suitable shape or style may be adapted to form the structure of hood casing 116.

In certain embodiments, multiple camera assemblies 114A, 114B are provided to capture images (e.g., static images or dynamic video) of a portion of cooktop appliance 300 or an area adjacent to cooktop appliance 300. Generally, each camera assembly 114A, 114B may be any type of device suitable for capturing a picture or video. As an example, each camera assembly 114A, 114B may be a video camera or a digital camera with an electronic image sensor [e.g., a charge coupled device (CCD) or a CMOS sensor]. Camera assembly 114 is in operable communication with controller 510A such that controller 510A may receive an image signal from camera assembly 114A or 114B corresponding to the picture captured by camera assembly 114A or 114B. Once received by controller 510A, the image signal may be further processed at controller 510A or transmitted to a separate device (e.g., remote server 404) in live or real-time for remote viewing (e.g., via one or more social media platforms). Optionally, one or more microphones (not pictured) may be associated with one or more of the camera assemblies 114A, 114B to capture and transmit audio signal (s) coinciding (or otherwise corresponding) with the captured image signal(s).

In exemplary embodiments, first camera assembly 114A is positioned above top surface 324 (e.g., along the vertical direction V). In some such embodiments, first camera assembly 114A is mounted (e.g., fixedly or removably) to hood casing 116. When assembled, first camera assembly 114A may be positioned directly above top surface 324.

In additional or alternative embodiments, another camera assembly (e.g., second camera assembly 114B) is directed away from top surface 324. In other words, second camera assembly 114B is oriented to capture light emitted or reflected from an area other than top surface 324. In particular, second camera assembly 114B may be directed at the area in front of cooktop appliance 300 (e.g., directly forward from cooktop appliance 300 along the transverse direction T). Thus, second camera assembly 114B may selectively capture an image of the area in front of top surface 324. This area may correspond to or cover the location where a user would stand during use of one or more heating elements 326. During use, a user's face or body may be captured by second camera assembly 114B while the user is standing directly in front of cooktop appliance 300. Optionally, second camera assembly 114B may be directed such that a line of sight is defined from second camera assembly 114B that is non-orthogonal to top surface 324 (e.g., between 0° and 45° relative to a plane parallel to top surface 324). The captured images from second camera assembly 114B may be suitable for transmission to a remote device or may be processed as a gesture control signal for a portion of interactive assembly 110 (e.g., to engage a graphical user interface displayed at image monitor 112).

As shown, second camera assembly 114B is positioned above top surface 324 (e.g., along the vertical direction V). In some such embodiments, such as that illustrated in FIGS. 1 and 2, second camera assembly 114B is mounted (e.g., fixedly or removably) to a front portion of hood casing 116 (e.g., at an image monitor 112). When assembled, second camera assembly 114B may be positioned directly above top surface 324 or, additionally, forward from cooktop appliance 300 along the transverse direction T.

In some embodiments, an image monitor 112 is provided, for instance, above top surface 324 (e.g., along the vertical direction V). In exemplary embodiments, image monitor 112 is mounted to hood casing 116 (e.g., directly above top surface 324). Generally, image monitor 112 may be any suitable type of mechanism for visually presenting an interactive or non-static image. For example, image monitor 112 may be a liquid crystal display (LCD), a plasma display panel (PDP), a cathode ray tube (CRT) display, etc. Thus, image monitor 112 includes an imaging surface 138 (e.g., screen or display panel) at which the digital image is presented or displayed as an optically-viewable picture (e.g., static image or dynamic video) to a user. The optically-viewable picture may correspond to any suitable signal or data received or stored by interactive assembly 110 (e.g., at controller 510A). As an example, image monitor 112 may present recipe information in the form of viewable text or images. As another example, image monitor 112 may present a remotely captured image, such as a live (e.g., real-time) dynamic video stream received from a separate user or device. As yet another example, image monitor 112 may present a graphical user interface (GUI) that allows a user to select or manipulate various operational features of interactive assembly 110 or cooktop appliance 300. During use of such GUI embodiments, a user may engage, select, or adjust the image presented at image monitor 112 through any suitable input, such as gesture controls detected through second camera assembly 114B, voice controls detected through one or more microphones, associated touch panels (e.g., capacitance or resistance touch panel) or sensors overlaid across imaging surface 138, etc.

In certain embodiments, the imaging surface 138 is directed away from, top surface 324. In particular, the imaging surface 138 may be directed toward the area forward from the cooktop appliance 300. During use, a user standing in front of cooktop appliance 300 may thus see the optically-viewable picture (e.g., recipe, dynamic video stream, graphical user interface, etc.) displayed at the imaging surface 138. Optionally, the imaging surface 138 may be positioned at a rearward non-orthogonal angle relative to the vertical direction. In other words, the imaging surface 138 may be inclined such that an upper edge of the imaging surface 138 is closer to the rear end 128 of hood casing 116 than a lower edge of the imaging surface 138 is. In some such embodiments, the non-orthogonal angle is between 1° and 15° relative to the vertical direction V. In certain embodiments, the non-orthogonal angle is between 2° and 7° relative to the vertical direction V.

As shown, particularly in FIG. 3, in certain embodiments, a user device 408 is operably coupled with network 502 such that user device 408 can communicate with interactive assembly 110, cooktop appliance 300, or external temperature probe 410. In some embodiments, user device 408 can communicate via network 502 directly with interactive assembly 110, cooktop appliance 300, or external temperature probe 410. Alternatively, user 402 can communicate indirectly by communicating via network 502 with remote server 404, which in turn communicates with interactive assembly 110, cooktop appliance 300, or external temperature probe 410 via network 502. Moreover, user 402 can be in operative communication with user device 408 such that user 402 can communicate with interactive assembly 110, cooktop appliance 300, or external temperature probe 410 via user device 408.

User device 408 can be any type of device, such as, for example, a personal computing device (e.g., laptop or desktop), a mobile computing device (e.g., smartphone or tablet), a gaming console or controller, a wearable computing device, an embedded computing device, a remote, or any other suitable type of user computing device. User device 408 can include one or more user device controllers 510E. Controller 510E can include one or more processors 512E and one or more memory devices 514E. The one or more processors 512E can be any suitable processing device (e.g., a processor core, a microprocessor, an ASIC, a FPGA, a controller, a microcontroller, etc.) and can be one processor or a plurality of processors that are operably coupled. The memory device (i.e., memory) can include one or more non-transitory computer-readable storage mediums, such as RAM, ROM, EEPROM, EPROM, flash memory devices, magnetic disks, etc., and combinations thereof. The memory can store data and instructions which are executed by the processor 512E to cause user device 408 to perform operations. Controller 510E a user device network interface 520E such that user device 408 can connect to and communicate over one or more networks (e.g., network 502) with one or more network nodes. Network interface 520E can be an onboard component of controller 510E or it can be a separate, off board component. Controller 510E can also include one or more transmitting, receiving, or transceiving components for transmitting/receiving communications with other devices communicatively coupled with user device 408. Additionally or alternatively, one or more transmitting, receiving, or transceiving components can be located off board controller 510E.

User device 408 can include one or more user inputs such as, for example, buttons, one or more cameras, or a monitor configured to display graphical user interfaces or other visual representations to user. For example, the monitor of the user device 408 can display graphical user interfaces corresponding to operational features of interactive assembly 110 or cooktop appliance 300 such that user may manipulate or select the features to operate interactive assembly 110 or cooktop appliance 300. In some such embodiments, the graphical user interface the user device 408 can display a temperature and corresponding color that matches the temperature and illumination color of external temperature probe 410.

The monitor of the user device 408 can be a touch sensitive component (e.g., a touch-sensitive display screen or a touch pad) that is sensitive to the touch of a user input object (e.g., a finger or a stylus). For example, a user may touch the monitor with his or her finger and type in a series of numbers on the monitor. In addition, motion of the user input object relative to the display can enable user to provide input to user device 408. User device 408 may provide other suitable methods for providing input to user device 408 as well. Moreover, user device 408 can include one or more speakers, one or more cameras, or more than one microphones such that user device 408 is configured with voice control, motion detection, and other functionality.

Generally, user 402 may be in operative communication with interactive assembly 110, cooktop appliance 300, secondary appliance 410, or one or more user devices 408. In some exemplary embodiments, user 402 can communicate with devices (e.g., interactive assembly 110) using voice control 406. User 402 may also be in operative communication via other methods as well, such as visual communication.

User 402 may wish to operate interactive assembly 110 remotely. In particular, user may wish to operate operational features that include activating portions of interactive assembly 110, turning on cooktop appliance 300, selecting a temperature or heat setting for cooktop appliance 300, following one or more guided action steps or recipes, or choosing a mode of operation of interactive assembly 110.

Figure 6:
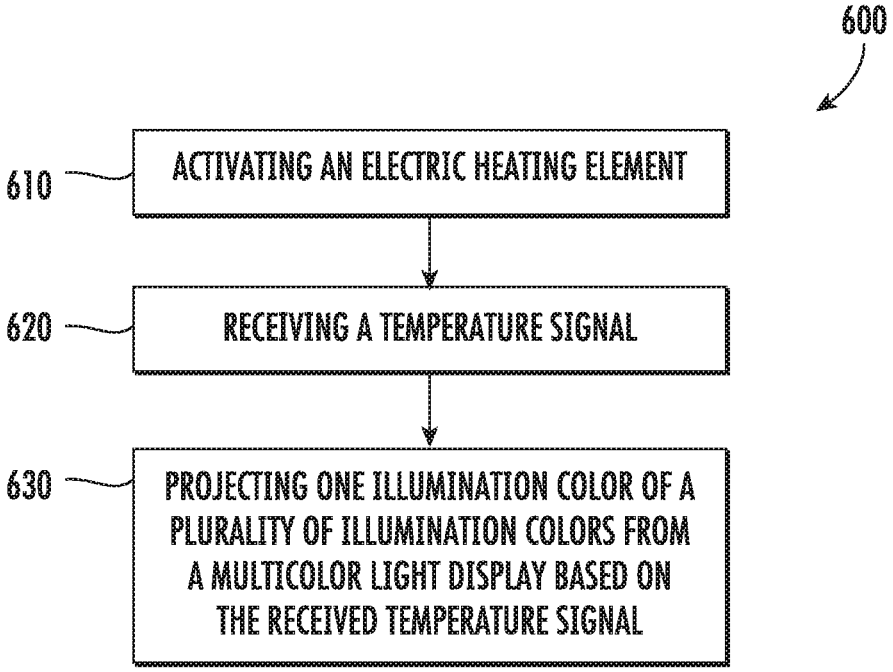
FIG. 6 provides a flow chart illustrating a method of operating a system according to exemplary embodiments of the present disclosure.
Figure 7:
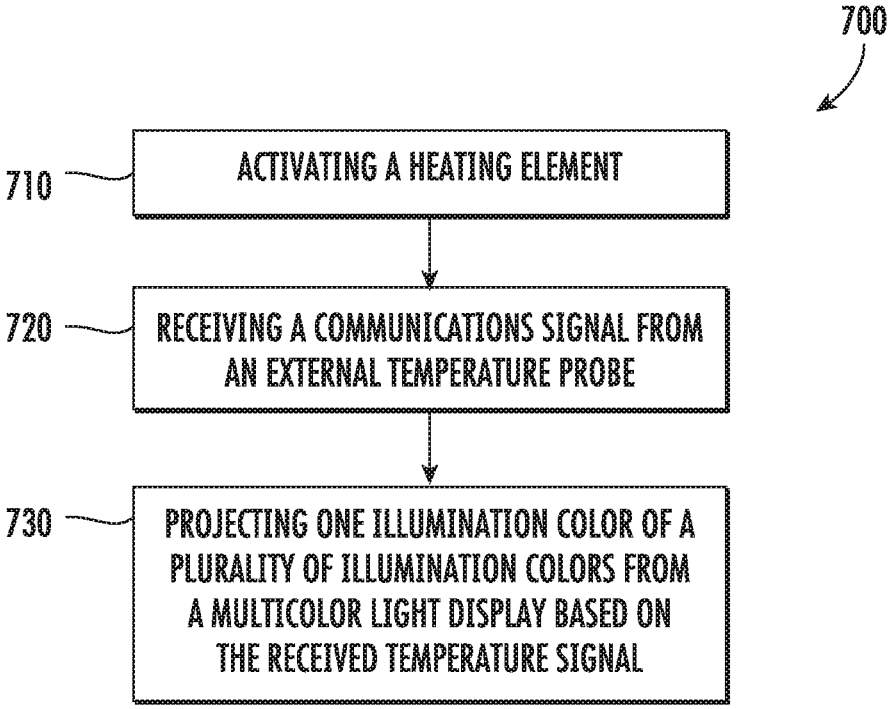
FIG. 7 provides a flow chart illustrating a method of operating a system according to exemplary embodiments of the present disclosure.
Figure 8:
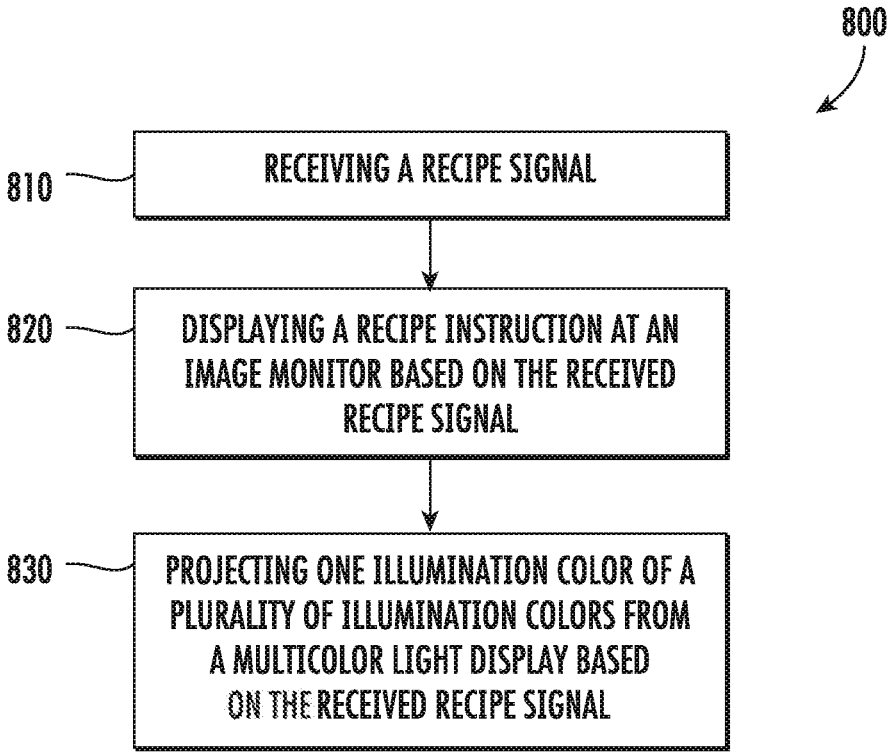
FIG. 8 provides a flow chart illustrating a method of operating a system according to exemplary embodiments of the present disclosure.

Referring now to FIGS. 6 through 8, various methods may be provided for use with system 100 in accordance with the present disclosure. In general, the various steps of methods as disclosed herein may, in exemplary embodiments, be performed by a controller (e.g., controller 510A, controller 510C, controller 510D, controller 510E, or a controller of remote server 404) as part of an operation that the controller is configured to initiate (e.g., a cooking operation). During such methods, the controller (e.g., controller 510A, controller 510C, controller 510D, controller 510E, or a controller of remote server 404) may receive inputs and transmit outputs from various other components of the system 100. For example, the controller (e.g., controller 510A, controller 510C, controller 510D, controller 510E, or a controller of remote server 404) may send signals to and receive signals from remote server 404, cooktop appliance 300, external temperature probe 410, user device 408, or interactive assembly 110. In particular, the present disclosure is further directed to methods, as indicated by 600, 700, 800, for operating system 100. Such methods advantageously facilitate the communication of information (e.g., to a user) that is easily and readily understood. In certain embodiments, such methods may advantageously facilitate guided or recorded cooking instructions.

FIGS. 6 through 8 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

Turning specifically to FIG. 6, at 610, method 600 includes activating an electric heating element. For instance, at least one of the heating elements mounted at the top surface of the cooktop appliance may be provided as an electric heating element, such as a resistive heating element, a radiant heating element, or an induction heating element. The electric heating element being activated may correspond to a specific user input, such as a knob, mounted to the control panel of the cooktop appliance. Engagement or rotation of the specific user input may direct the controller to activate (e.g., direct electrical current to) the corresponding electric heating element. In other words, the electric heating element may generally be controlled by the corresponding user input.

At 620, the method 600 includes receiving a temperature signal. In particular, the temperature signal is received subsequent to or after activating the electric heating element at 610. Nonetheless, it is understood that the electric heating element may remain active during 620. The temperature signal may correspond to a detected temperature or a desired temperature setting. For instance, the temperature signal may be received from an external temperature probe positioned at the corresponding heating element (e.g., the heating element activated at 610). The temperature signal may, thus, indicate an actual temperature detected at the external temperature probe. Alternatively, the temperature signal may be received from the user input as a temperature setting signal. The temperature signal may, thus, indicate the desired temperature setting for the corresponding heating element (e.g., irrespective of whether a specific temperature has been reached at the corresponding heating element).

At 630, the method includes projecting one illumination color of the plurality of illumination colors from the multicolor light display. As described above, the multicolor light display may be positioned about a corresponding user input, such as the user input corresponding to the activated heating element. In other words, the multicolor light display may correspond to the activated heating element at 610.

In certain embodiments, the illumination color that is projected is based on the received temperature signal at 620. Multiple different illumination colors of the plurality of illumination colors may correspond to different temperatures or ranges. In turn, the illumination color projected at 630 may generally indicate a temperature (e.g., detected temperature or temperature setting) of the activated heating element.

In some embodiments, the illumination color projected from the multicolor light display may vary with changes in temperature of the corresponding heating element. In other words, method 600 may include receiving additional temperature signals or signals subsequent to the temperature signal received at 620. The method 600 may further include projecting a different unique illumination color of the plurality of illumination colors based on the received additional temperature signal. Advantageously, the user may have a readily discernible and visible indication of the temperature at a specific heating element on the top surface of the cooktop appliance.

In additional or alternative embodiments, each of the heating elements on the top surface of the cooktop appliance corresponds to a unique input assembly (e.g., user input and multicolor light display positioned thereabout). Each heating element and corresponding input assembly may operate according to method 600 and independently of each of the other heating elements and corresponding input assemblies.

Turning specifically to FIG. 7, at 710, the method 700 includes activating a heating element. The heating element may be an electric heating element or, alternatively, gas heating element. The heating element being activated may correspond to a specific user input, such as a knob, mounted to the control panel of the cooktop appliance. Engagement rotation of the specific user input may direct the controller to activate (e.g., ignite or direct electrical current to) the corresponding heating element.

At 720, the method 700 includes receiving a communications signal from an external temperature probe. The external temperature probe may be configured to correspond to the heating element activated at 710. Moreover, the external temperature probe may be configured to correspond to an input assembly (e.g., user input and multicolor light display positioned thereabout) that generally control the temperature or heat at the corresponding heating element. Optionally, a plurality of external temperature probes may be provided. In some such embodiments, each external temperature probe of the plurality of external temperature probes corresponds to a unique input assembly.

At 730, the method 700 includes projecting one illumination color of the plurality of illumination colors from the multicolor light display (e.g., the multicolor light display corresponding to the activated heating element at 710). The illumination color that is projected may be based on the received communications signal at 720. Thus, the projected illumination color at 730 may generally indicate a connection with the external temperature probe (e.g., first external temperature probe). Optionally, multiple different illumination colors of the plurality of illumination colors may correspond to different communication signals or external temperature probes. In some such embodiments, a discrete illumination color of the plurality of illumination colors corresponds to each probe of the plurality of external temperature probes.

In certain embodiments, the external temperature probe includes a probe display configured to emit an identifying illumination color. In particular, the identifying illumination color projected or emitted from the probe display may match the one illumination color projected by the multicolor light display described at 720. For instance, both the probe display and the multicolor light display may project a green light, thereby advantageously providing an indication of communication and correlation between the external temperature probe and the corresponding input assembly.

In additional or alternative embodiments, the cooktop appliance includes a digital appliance screen that is operably coupled to the external temperature probe. Optionally, the controller may be configured to present or display a detected temperature (e.g., measured at the external temperature probe) on the digital appliance screen. Thus, the method 700 may include receiving a temperature signal from the external temperature probe. From the received temperature signal, controller may determine a temperature value (e.g., the temperature measured at the external temperature probe). Upon receiving a temperature signal to determining the temperature value, the digital appliance screen may simultaneously display the temperature value and a screen illumination color that matches the identifying illumination color projected by the external temperature probe. For instance, both the probe display and the digital appliance being may project a green light, thereby advantageously indicating communication and correlation between the external temperature probe and temperature value visible at the digital appliance screen.

Turning specifically to FIG. 8, at 810, the method 800 includes receiving a recipe signal. For instance, the recipe signal may be received from a remote server or user device. The recipe signal may generally indicate information related to a cooking task or food item to be performed, at least in part, by a user.

In some embodiments, the method 800 includes coordinating activation of the image monitor (e.g., above the cooktop appliance) in the multicolor light display of the cooktop appliance. For instance, 820 and 830 may be performed simultaneously, or in a predetermined sequence, even though the image monitor and the multicolor light display may be spaced apart from each other.

At 820, the method 800 includes displaying a recipe instruction at the image monitor. The displayed recipe instruction is generally based on the received recipe signal. Moreover, the displayed recipe instruction may be a static or, alternatively, an animated image providing information (e.g., in the form of text) regarding steps to be performed by a user. For instance, displayed recipe instruction may include information regarding where, how long, and that what temperature and item of food may be cooked on the cooktop appliance.

At 830, the method 800 includes projecting one illumination color of the plurality of illumination colors from the multicolor light display. The illumination color that is projected may be based on the received recipe signal. For instance, the illumination color may indicate that a specific heating element corresponding to multicolor light display that should be activated in order to follow the recipe instruction.

In some embodiments, the projected illumination color provides confirmation of a completed task or step of the recipe instruction displayed at the image monitor. As an example, projection of the illumination color at 830 may be in response to, or contingent upon, activation of the heating element subsequent to reading the recipe signal at 810. As an additional or alternative example, the projected illumination color may change or vary in response to a predetermined condition being met. For instance, if one illumination color is projected in response to activation of the heating element, the method 800 may include detecting another (i.e., unique or discrete) illumination color of the plurality of illumination colors from the multicolor light display in response to a predetermined recipe temperature being met at the heating element. A determination that the predetermined recipe temperature is met may be made in response to a received temperature signal (e.g., from the external temperature probe) or a received temperature setting signal (e.g., from the user input). As yet another additional or alternative example, an illumination color of the plurality of illumination colors may be projected in response to completion of a task. The specific illumination color may be provided at the expiration of a predetermined recipe interval (e.g., span of time following activation of the heating element or the heating element reaching the predetermined recipe temperature).

In optional embodiments, projection of a color light from the multicolor the light display may be varied (e.g., strobed, flashed, or alternated). For instance, the multicolor light display may project a predetermined illumination sequence that varies emissions from the multicolor light display. The variations may include alternating intensity or illumination color of the light projected from the multicolor light display This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a housing defining a top surface and a control panel;

a heating element mounted to the housing at the top surface;

a user input mounted to the housing at the control panel;

a multicolor light display positioned about the user input at the control panel, the multicolor display being configured to selectively emit a plurality of illumination colors;

an external temperature probe independently movable relative to the housing;

a digital appliance screen mounted to the housing; and a controller operably coupled to the multicolor light display, the digital appliance screen, and the external temperature probe, the controller being configured to initiate a color-variable cooking operation, the color-variable cooking operation comprising activating the heating element, receiving a communications signal from the external temperature probe, projecting one illumination color of the plurality of illumination colors from the multicolor light display corresponding to the external temperature probe, receiving a temperature signal from the external temperature probe, and simultaneously displaying a temperature value based on the temperature signal and a screen illumination color at the digital appliance screen, wherein the screen illumination color matches the identifying illumination color.

2. The cooktop appliance of claim 1, wherein the electric heating element comprises a resistive heating element.

3. The cooktop appliance of claim 1, wherein the electric heating element comprises an induction heating element.

4. The cooktop appliance of claim 1, wherein the electric heating element comprises a radiant heating element.

5. The cooktop appliance of claim 1, wherein the external temperature probe is a first probe of a plurality of external temperature probes operably coupled to the controller.

6. The cooktop appliance of claim 5, wherein a discrete illumination color of the plurality of illumination colors corresponds to each probe of the plurality of external temperature probes.

7. The cooktop appliance of claim 1, wherein the external temperature probe comprises a probe display configured to emit an identifying illumination color matching the one illumination color of the plurality of illumination colors.

8. A cooking engagement system comprising:

a cooktop appliance comprising a housing defining a top surface and a control panel, a heating element mounted to the housing at the top surface, a user knob mounted to the housing at the control panel, and a multicolor light display circumferentially surrounding the user input knob at the control panel, the multicolor display being configured to selectively emit a plurality of illumination colors;

an external temperature probe independently movable relative to the housing;

an image monitor spaced apart from the top surface of the cooktop appliance; and a controller operably coupled to the multicolor light display and the image monitor, the controller being configured to initiate a color-variable cooking operation, the color-variable cooking operation comprising reading a recipe signal, presenting a recipe instruction at the image monitor based on the recipe signal, the recipe instruction comprising text regarding user steps for a food item to be cooked, coordinating activation of the image monitor and the multicolor light display according to the presented recipe instruction at the image monitor, receiving a communications signal from the external temperature probe, projecting one illumination color of the plurality of illumination colors from the multicolor light display corresponding to the external temperature probe, receiving a temperature signal from the external temperature probe, and simultaneously displaying a temperature value based on the temperature signal and a screen illumination color, wherein the screen illumination color matches the identifying illumination color.

9. The cooking engagement system of claim 8, wherein coordinating activation of the image monitor and the multicolor light display comprises projecting one illumination color of the plurality of illumination colors from the multicolor light display in response to activation of the heating element subsequent to reading the recipe signal.

10. The cooking engagement system of claim 9, wherein coordinating activation of the image monitor and the multicolor light display further comprises projecting another illumination color of the plurality of illumination colors from the multicolor light display in response to a predetermined recipe temperature being met at the heating element.

11. The cooking engagement system of claim 8, wherein coordinating activation of the image monitor and the multicolor light display comprises projecting a predetermined illumination sequence that varies emissions from the multicolor light display.

12. The cooking engagement system of claim 8, wherein coordinating activation of the image monitor and the multicolor light display comprises projecting one illumination color of the plurality of illumination colors from the multicolor light display in response to expiration of a predetermined recipe interval.

13. The cooking engagement system of claim 8, wherein the cooktop appliance further comprises a plurality of heating elements mounted to the housing at the top surface, a plurality of user input knobs mounted to the housing at the control panel, each user input knob of the plurality of user input knobs corresponding to a discrete heating element of the plurality of heating elements, and a plurality of multicolor light displays, each display of the plurality of multicolor light displays being circumferentially surrounding a discrete user input knob of the plurality of user input knobs, wherein coordinating activation of the image monitor and the multicolor light display comprises activating a unique display of the plurality of multicolor light displays according to the presented recipe instruction.

14. The cooking engagement system of claim 8, wherein the image monitor is positioned above the top surface and is directed away from the top surface.

* * * * *